US010599102B2

(12) United States Patent
Sawada et al.

(10) Patent No.: US 10,599,102 B2
(45) Date of Patent: Mar. 24, 2020

(54) TIMEPIECE WITH AN ANTENNA

(71) Applicant: CASIO COMPUTER CO., LTD., Shibuya-ku, Tokyo (JP)

(72) Inventors: Makoto Sawada, Nishi-Tokyo (JP); Kazumasa Yokoo, Higashiyamato (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 148 days.

(21) Appl. No.: 15/869,697

(22) Filed: Jan. 12, 2018

(65) Prior Publication Data

US 2018/0231942 A1 Aug. 16, 2018

(30) Foreign Application Priority Data

Feb. 14, 2017 (JP) ..... 2017-024732

(51) Int. Cl.

| | |
|---|---|
| ***G04R 60/10*** | (2013.01) |
| ***G04B 33/00*** | (2006.01) |
| ***G04B 19/24*** | (2006.01) |
| ***G04B 19/06*** | (2006.01) |

(52) U.S. Cl.

CPC ..... *G04R 60/10* (2013.01); *G04B 19/06* (2013.01); *G04B 19/24* (2013.01); *G04B 33/00* (2013.01)

(58) Field of Classification Search

CPC ..... G04R 60/10; G04B 19/06; G04B 19/24; G04B 33/00

USPC ..... 368/278

See application file for complete search history.

(56) References Cited

U.S. PATENT DOCUMENTS

| | | | | |
|---|---|---|---|---|
| 7,230,885 | B2 | 6/2007 | Sakurazawa et al. | |
| 9,523,963 | B2 | 12/2016 | Fujisawa et al. | |
| 9,766,597 | B2 | 9/2017 | Fujisawa et al. | |
| 9,869,975 | B2 | 1/2018 | Fujisawa et al. | |
| 10,031,487 | B2 * | 7/2018 | Fujisawa | G04R 20/02 |
| 2005/0047282 | A1 | 3/2005 | Sakurazawa et al. | |
| 2014/0022871 | A1 * | 1/2014 | Fujisawa | G04G 5/002 368/28 |
| 2015/0268636 | A1 * | 9/2015 | Sawada | G04R 20/02 368/47 |
| 2016/0161920 | A1 | 6/2016 | Fujisawa et al. | |
| 2016/0357160 | A1 * | 12/2016 | Fujisawa | G04R 20/02 |
| 2017/0060099 | A1 | 3/2017 | Fujisawa et al. | |
| 2017/0343964 | A1 | 11/2017 | Fujisawa et al. | |

FOREIGN PATENT DOCUMENTS

| | | | |
|---|---|---|---|
| CN | 101169619 | A | 4/2008 |
| CN | 105676630 | A | 6/2016 |
| JP | 2005098975 | A | 4/2005 |

(Continued)

OTHER PUBLICATIONS

Japanese Office Action dated Dec. 5, 2018 (and English translation thereof) issued in counterpart Japanese Application No. 2017-024732.

(Continued)

*Primary Examiner* — Edwin A. Leon
(74) *Attorney, Agent, or Firm* — Holtz, Holtz & Volek PC

(57) ABSTRACT

A timepiece including an antenna, a holding member arranged with a predetermined space above the antenna, a pointer shaft arranged corresponding to an area above the antenna and rotatably held by the holding member, and a pointer mounted on the pointer shaft.

16 Claims, 4 Drawing Sheets

(56) References Cited

FOREIGN PATENT DOCUMENTS

| | | | |
|---|---|---|---|
| JP | 2009270933 | A | 11/2009 |
| JP | 2012093210 | A | 5/2012 |
| JP | 2016176957 | A | 10/2016 |

OTHER PUBLICATIONS

Chinese Office Action dated Sep. 26, 2019 (and English translation thereof) issued in Chinese Application No. 201810077407.2.

* cited by examiner

TIMEPIECE WITH AN ANTENNA

CROSS-REFERENCE TO RELATED APPLICATION

This application is based upon and claims the benefit of priority from the prior Japanese Patent Application No. 2017-024732, filed Feb. 14, 2017, the entire contents of which are incorporated herein by reference.

BACKGROUND OF THE INVENTION

1. Field of the Invention

The present invention relates to a timepiece such as a wristwatch.

2. Description of the Related Art

For example, a wristwatch is known which includes an antenna for a Global Positioning System (GPS), as described in Japanese Patent Application Laid-Open (Kokai) Publication No. 2012-093210. In this type of wristwatch, the size of the antenna has been increased to enhance the reception sensitivity of the antenna.

In such a wristwatch, in a case where a pointer shaft overlaps with an antenna in the thickness direction of the wristwatch, a through hole is provided in the antenna, and the pointer shaft is provided in the through hole. However, the reception sensitivity of the antenna may be decreased and the processability and assemblability thereof may be deteriorated if the through hole is provided in the antenna.

Accordingly, a structure has been conceived in which a pointer shaft is provided at a position avoiding an antenna. However, in this structure, the antenna restricts the arrangement position of the pointer shaft, which results in a poor design.

SUMMARY OF THE INVENTION

An object of the present invention is to provide a timepiece where the sensitivity of an antenna can be ensured and a pointer shaft can be freely arranged without affecting the antenna.

In accordance with one aspect of the present invention, there is provided a timepiece comprising: an antenna; a holding member arranged with a predetermined space above the antenna; a pointer shaft arranged corresponding to an area above the antenna and rotatably held by the holding member; and a pointer mounted on the pointer shaft.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment in which the present invention has been applied in a wristwatch will hereinafter be described with reference to FIG. 1 to FIG. 4.

Figure 1:
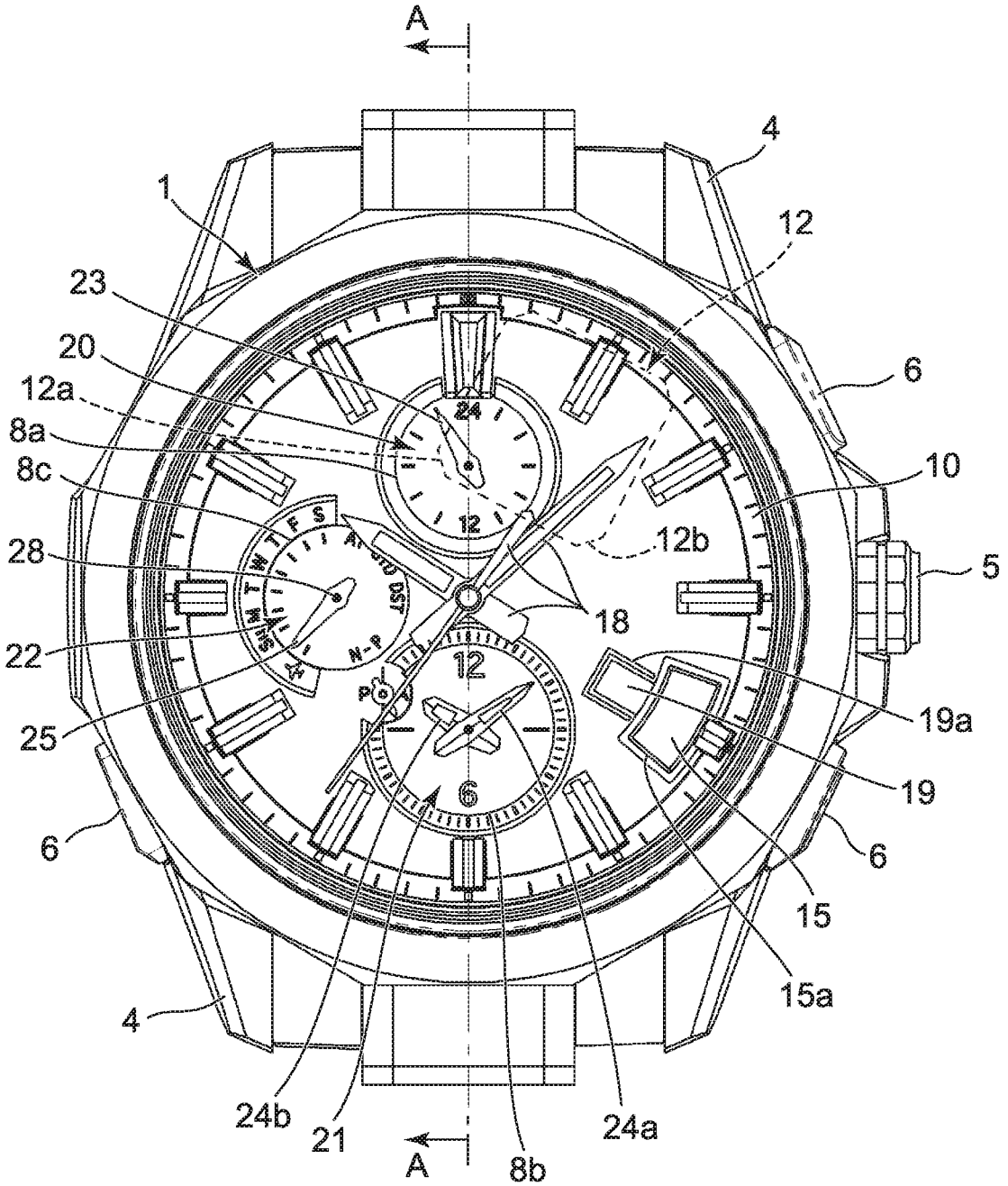
FIG. 1 is an enlarged front view showing an embodiment in which the present invention has been applied in a wristwatch.
Figure 2:
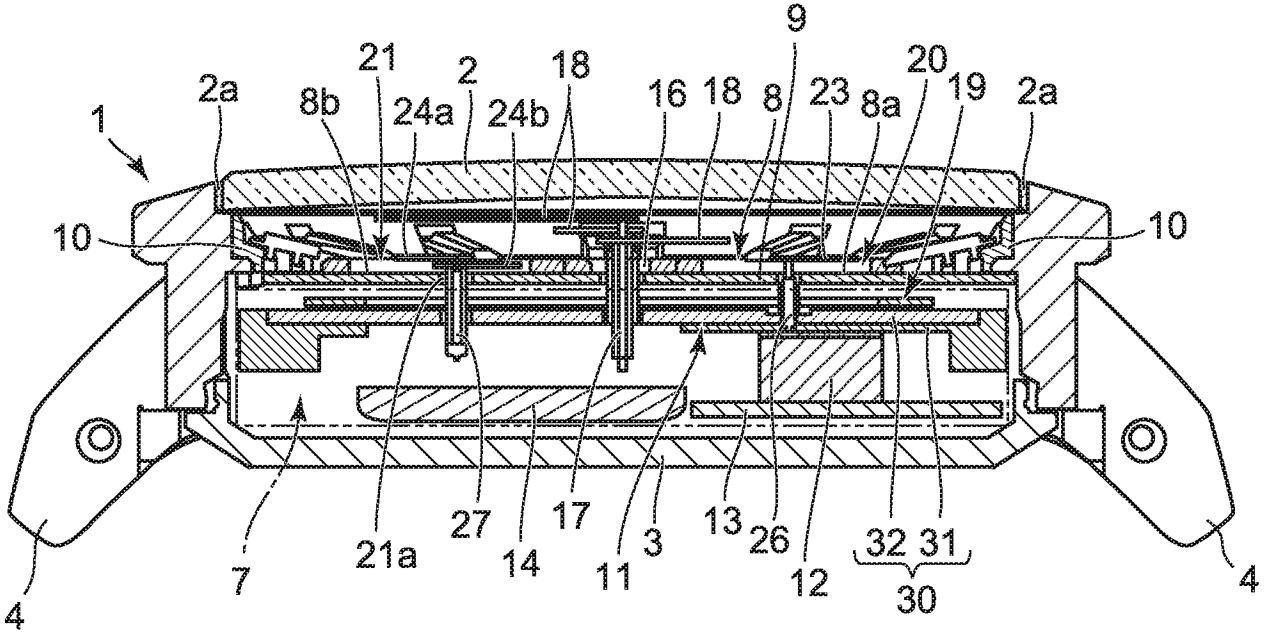
FIG. 2 is an enlarged sectional view of the wristwatch taken along line A-A in FIG. 1.

This wristwatch includes a wristwatch case 1, as shown in FIG. 1 and FIG. 2. This wristwatch case 1 has a watch glass 2 mounted on its upper opening portion via a packing 2*a*, and a rear lid 3 attached to its lower portion.

Also, this wristwatch case 1 has band attaching sections 4 provided on the six o'clock side and the twelve o'clock side of its outside surface, as shown in FIG. 1 and FIG. 2. Moreover, this wristwatch case 1 has a switch operation section 5 such as a crown provided on its side surface on the three o'clock side and push-button switches 6 provided on its side surfaces on the two o'clock side, the four o'clock side, and the eight o'clock side.

In this wristwatch case 1, a timepiece module 7 is incorporated, as shown in FIG. 2. In an area above this timepiece module 7, a dial plate 8 is arranged via a solar panel 9. On an outer peripheral portion on the upper side of this dial plate 8, a ring-shaped parting member 10 is provided.

The timepiece module 7 includes a timepiece movement 11, an antenna 12, a circuit board 13, a button battery 14, and a display section 15 (refer to FIG. 1), as shown in FIG. 2. The timepiece movement 11 includes a pointer shaft 17 inserted into a through hole 16 in respective center portions of the dial plate 8 and the solar panel 9 and protruding upward from the dial plate 8, as shown in FIG. 1 and FIG. 2.

At the top end of the pointer shaft 17, a plurality of metallic pointers 18, such as an hour hand, a minute hand and a second hand, are mounted, as shown in FIG. 1 and FIG. 2. As a result, the timepiece movement 11 is structured to move the plurality of pointers 18 above the dial plate 8 by rotating the pointer shaft 17 in conjunction with a wheel train mechanism and thereby indicate and display the time.

Also, the timepiece movement 11 includes first to third sub-display sections 20 to 22 and a date wheel 19, as shown in FIG. 1 and FIG. 2. Accordingly, the timepiece movement 11 is structured to move a first short pointer 23 that is a first pointer of the first sub-display section 20, second short pointers 24*a* and 24*b* that are two second pointers of the second sub-display section 21, and a third short pointer 25 that is a third pointer of the third sub-display section 22, respectively, on the dial plate 8 while rotating and moving the date wheel 19 below the dial plate 8 and the solar panel 9 along the outer periphery of the dial plate 8.

In this embodiment, the first sub-display section 20, which displays the time in units of hours, is structured to be operated in conjunction with a wheel train mechanism (not shown) with the first short pointer 23 which is the first pointer and made of a metallic material being mounted on a first pointer shaft 26, as shown in FIG. 1 and FIG. 2. This first sub-display section 20 is arranged in an area between the through hole 16 in a center portion of the dial plate 8 and an end of the dial plate 8 on the twelve o'clock side.

That is, this first sub-display section 20 is structured such that an indication and display area where the time is displayed in units of hours by the first short pointer 23 being rotated by 360 degrees is formed in a substantially circular shape and the first pointer shaft 26 is arranged by being inserted into a first through hole 20*a* provided in the dial plate 8 and the solar panel 9 and positioned in the center of the indication and display area, as shown in FIG. 1 and FIG. 2. In this embodiment, the indication and display area includes a circular hole 8*a* provided in the dial plate 8 and having a radius corresponding to the length of the first short pointer 23, and the first short pointer 23 is structured to be moved with it being positioned above this circular hole 8*a* of the dial plate 8.

Also, the second sub-display section 21, which displays the world time representing the time of each city in the world, is structured to be operated in conjunction with a wheel train mechanism (not shown) with the second short pointers 24*a* and 24*b* which are the two second pointers and made of a metallic material being mounted on the second hand shaft 27, as shown in FIG. 1 and FIG. 2. This second sub-display section 21 is arranged in an area between the through hole 16 in the center of the dial plate 8 and an end of the dial plate 8 on the six o'clock side.

Also, this second sub-display section 21 is structured such that an indication and display area where the time in each city in the world is indicated and displayed by the two second short pointers 24*a* and 24*b* being rotated by 360 degrees is formed in a circular shape and the second hand shaft 27 is arranged by being inserted into the second through hole 21*a* provided in the dial plate 8 and the solar panel 9 and positioned in the center of the indication and display area, as shown in FIG. 1 and FIG. 2.

In this embodiment, the two second short pointers 24*a* and 24*b* are formed such that their respective lengths differ from each other and the second short pointer 24*a* is longer than the second short pointer 24*b*, as shown in FIG. 1 and FIG. 2. The indication and display area includes a circular hole 8*b* provided in the dial plate 8 and having a radius corresponding to the length of the longer second short pointer 24*a*, and the two second short pointers 24*a* and 24*b* are structured to be moved with them being positioned within the circular hole 8*b* of the dial plate 8.

In this embodiment, the display section 15 in the timepiece module 7, which displays information such as the name of a city whose current time is being indicated and displayed in the second sub-display section 21, is provided to be positioned in an area on the 4 o'clock side of the dial plate 8, as shown in FIG. 1. This display section 15 is a flat display panel such as a liquid crystal display panel or an electroluminescence (EL) display panel.

This display section 15 is arranged corresponding to an area below a display window section 15*a* provided in the dial plate 8 and the solar panel 9, and electrooptically displays information such as the name of a city whose current time is being indicated and displayed in the second sub-display section 21, as shown in FIG. 1 and FIG. 2. Note that this display section 15 may be formed having a ring shape as with the date wheel 19, and structured to be rotated and moved below the dial plate 8 and the solar panel 9 along the outer periphery of the dial plate 8.

Also, the third sub display section 22, which displays information regarding a day of the week, an alarm, or a timer, is structured to be operated in conjunction with a wheel train mechanism (not shown) with the third short pointer 25 which is the third pointer and made of a metallic material being mounted on a third pointer shaft 28, as shown in FIG. 1. This third sub-display section 22 is arranged in an area between the through hole 16 in the center of the dial plate 8 and an end of the dial plate 8 on the nine o'clock side.

Also, this third sub-display section 22 is structured such that an indication and display area where information regarding a day of the week, an alarm, or a timer is indicated and displayed by the third short pointer 25 being rotated by 360 degrees is formed in a substantially circular shape and the third pointer shaft 28 is arranged by being inserted into a third through hole (not shown) provided in the dial plate 8 and the solar panel 9 and positioned in the center of the indication and display area, as shown in FIG. 1.

In this embodiment, the indication and display area includes a circular hole 8*c* provided in the dial plate 8 and having a radius corresponding to the length of the third short pointer 25, as shown in FIG. 1. In a nearly left half of this circular hole 8*c* and its surrounding area, information regarding a day of the week is displayed. In the other half thereof, information regarding an alarm and a timer is displayed, as shown in FIG. 1. As a result, the third short pointer 25 is structured to be moved with it being positioned within the circular hole 8*c* of the dial plate 8 and selectively indicate information regarding a day of the week, an alarm, or a timer.

Also, the date wheel 19 in the timepiece movement 11 has a ring shape smaller than the outer periphery of the dial plate 8, as shown in FIG. 1 and FIG. 2. On the upper surface of the date wheel 19, dates "1" to "31" are displayed at equal intervals in the circumferential direction. This date wheel 19 is structured such that one of the dates "1" to "31" is positioned on the 4 o'clock side of the dial plate 8 and corresponds to a day display window section 19*a* provided adjacent to the display section 15, so that this date corresponding to the day display window section 19*a* can be viewed from above via the day display window section 19*a*.

Figure 3:
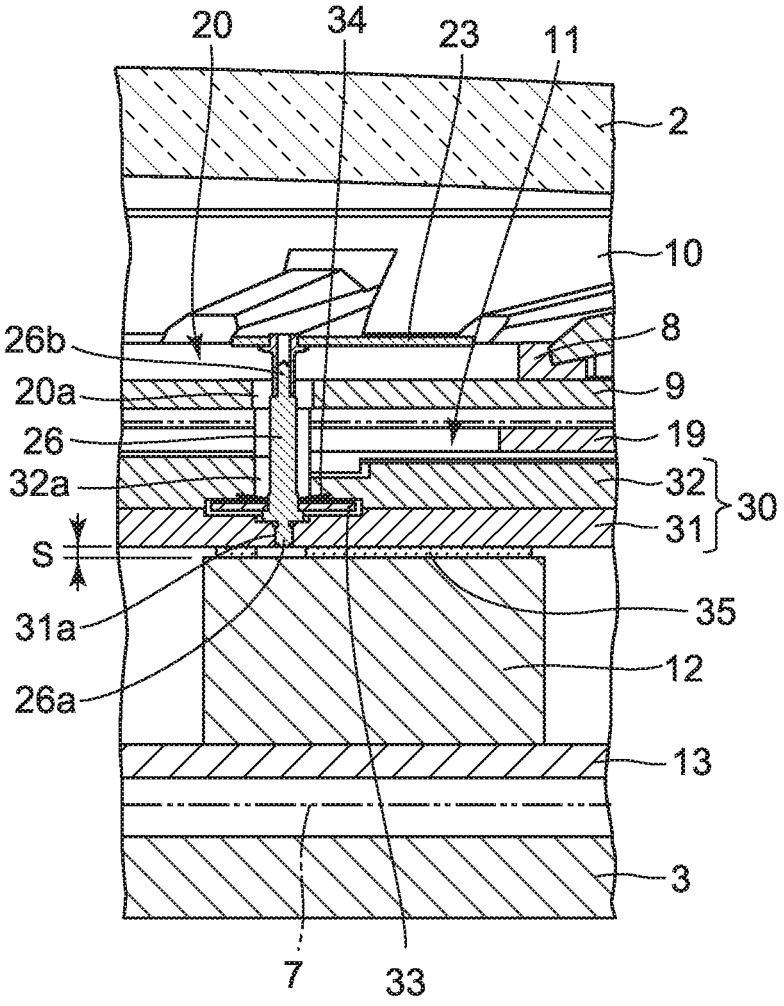
FIG. 3 is an enlarged sectional view showing the main section of a timepiece module shown in FIG. 2.

The antenna 12 is a patch antenna which receives a high-frequency radio wave for GPS (for example, a radio wave of 1575.42 MHz), and has a substantially square shape, as shown in FIG. 1 to FIG. 3. This antenna 12, which is provided on the circuit board 13 with it being electrically connected thereto, is structured such that it is mounted below the timepiece movement 11 when the circuit board 13 is attached below the timepiece movement 11.

As a result, this antenna 12 is structured such that, when arranged below the timepiece movement 11, it is positioned in an area that is located from around the twelve o'clock portion of the timepiece module 7 to around the two o'clock portion via the one o'clock portion and located between the through hole 16 in the center of the dial plate 8 and an edge portion of the dial plate 8 near the one o'clock side, as shown in FIG. 1 and FIG. 2.

That is, this antenna 12 is arranged such that, among the corner sections 12*a* and 12*b* of its side portion on the side of the through hole 16 in the center portion of the dial plate 8, the square portion 12*a* on the twelve o'clock side projects significantly into and overlaps with an area below the first sub-display section 20 because its antenna field has a substantially square shape, as shown in FIG. 1.

Accordingly, the first pointer shaft 26 of the first sub-display section 20 is structured to be rotatably held by a holding member 30 while corresponding to an area above the antenna 12, as shown in FIG. 2 and FIG. 3. This holding member 30 includes a bottom plate 31 and a wheel train bridge 32 incorporated into the timepiece movement 11, and is structured such that the bottom plate 31 is arranged above the antenna 12 in a non-contact state and the wheel train bridge 32 is arranged on the bottom plate 31.

Figure 4:
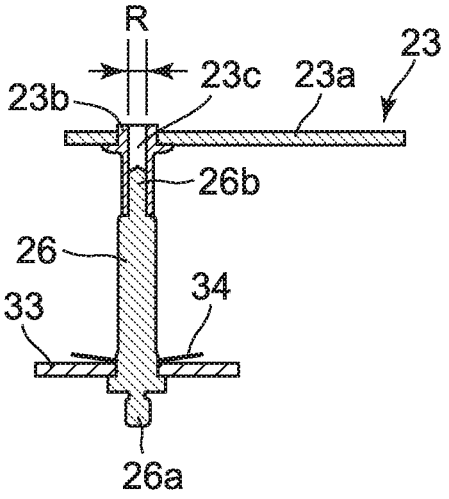
FIG. 4 is an enlarged sectional view of the main section showing a pointer shaft and a pointer shown in FIG. 3.

In this embodiment, the first pointer shaft 26 has a gear wheel 33 provided on its lower portion, and is structured such that, when the gear wheel 33 is rotated in conjunction with a wheel train mechanism (not shown) in the timepiece movement 11, the first pointer shaft 26 is rotated together with this gear wheel 33 so as to move the first short pointer 23 that is the first pointer, as shown in FIG. 3 and FIG. 4. Also, on the first pointer shaft 26, a disc spring 34 is provided and positioned above the gear wheel 33.

That is, the first pointer shaft 26 is structured such that its lower end 26*a* is inserted into a hearing hole 31*a* provided in the bottom plate 31 of the holding member 30 and rotatably held therein, as shown in FIG. 3. Also, the first pointer shaft 26 is structured such that its upper end 26*b* is inserted into an insertion hole 32*a* provided in the wheel train bridge 32 of the holding member 30 while protruding upward from the dial plate 8 via the first through hole 20*a* of the solar panel 9 and the circular hole 8*a* of the dial plate 8, and the disc spring 34 is elastically pressed by the wheel train bridge 32 in this state.

As a result, the first pointer shaft 26 is structured such that it is rotatably attached to the holding member 30 with the gear wheel 33 and the disc spring 34 being arranged and interposed between the bottom plate 31 and the wheel train bridge 32 of the holding member 30, and the first short pointer 23 that is the first pointer is mounted on the upper end 26*b* of the first pointer shaft 26 in this state, as shown in FIG. 3.

Here, the first short pointer 23 is structured such that, when mounted on the first pointer shaft 26, the bottom plate 31 of the holding member 30 is mounted on the first pointer shaft 26 without coming in contact with the antenna 12, as shown in FIG. 3 and FIG. 4. That is, the mounting force at the time of mounting the first pointer 23 on the first pointer shaft 26 is set equal to or less than the deforming force with which the bottom plate 31 of the holding member 30 is flexurally deformed.

In this embodiment, the first short pointer 23 is structured such that a mounting piece 23*b* referred to as "hakama" is provided on one end side of a pointer body 23*a*, a mounting hole 23*c* is provided in the mounting piece 23*b*, and the upper end 26*b* of the first pointer shaft 26 is mounted in the mounting hole 23*c* in the mounting piece 23*b* by being press-fitted thereinto, as shown in FIG. 3 and FIG. 4. Accordingly, the contact area of the mounting hole 23*c* provided in the mounting piece 23*b* of the first short pointer 23 and the upper end 26*b* of the first pointer shaft 26 mounted in the mounting hole 23*c* by press fitting is formed small.

That is, the upper end 26*b* of the first pointer shaft 26 to which the first short pointer 23 is mounted by press fitting is formed having a thin shape whose outer diameter R is 1.0 mm or less, as shown in FIG. 4. In addition, the first short pointer 23 is formed such that the inner diameter of the mounting hole 23*c* in the mounting piece 23*b* is substantially the same as the outer diameter R of the upper end 26*b* of the first pointer shaft 26. That is, it is formed with a fitting tolerance between the upper end 26*b* of the first pointer shaft 26 and the mounting hole 23*c* of the first short pointer 23.

As a result, the first short pointer 23 is formed such that a press fitting force when the upper end 26*b* of the first pointer shaft 26 is pressed into the mounting hole 23*c* is small and, even though the press fitting force is small, a fitting force when the upper end 26*b* of the first pointer shaft 26 is fitted into the mounting hole 23*c* of the first short pointer 23 is secured by the fitting tolerance between the upper end 26*b* of the first pointer shaft 26 and the mounting hole 23*c* of the first short pointer 23, as shown in FIG. 4.

Also, the bottom plate 31 of the holding member 30, which is arranged with a predetermined space S above the antenna 12, is formed such that it can be flexurally deformed within the range of the predetermined space S when the first short pointer 23 is mounted on the first pointer shaft 26, as shown in FIG. 3. That is, the bottom plate 31 is formed such that its deforming force is equal to or less than a maximum deforming force with which flexural deformation of the holding member 30 is within the range of the predetermined space S. As a result the bottom plate 31 is thin so that it is flexurally deformed within the range of the predetermined space S without coming in contact with the antenna 12 when the first short pointer 23 is mounted on the first pointer shaft 26.

In the space S between this antenna 12 and the bottom plate 31, a buffer member 35 is arranged avoiding an area corresponding to the first pointer shaft 26, as shown in FIG. 3. This buffer member 35 is structured to suppress the flexural deformation of the bottom plate 31 while protecting the antenna 12 from being impacted and damaged by preventing the bottom plate 31 from coming in contact with the antenna 12 when the first short pointer 23 is mounted on the first pointer shaft 26 by press fitting.

Also, this buffer member 35 is structured such that, when an impact is exerted on the timepiece case 1 from outside, it buffers the impact so that the impact is not transmitted to the antenna 12 and thereby prevents the antenna 12 from being impacted and damaged while preventing sections electrically connecting the antenna 12 and the circuit board 13 from being damaged, as shown in FIG. 2 and FIG. 3.

Next, the operation of this wristwatch will be described. Before this wristwatch is assembled, the timepiece movement 11 in the timepiece module 7 is assembled. At this stage, the pointer 18 is not mounted on the pointer shaft 17 in the timepiece movement 11. Similarly, the first short pointer 23 is not mounted on the first pointer shaft 26 of the first sub-display section 20, the second short pointers 24*a* and 24*b* are not mounted on the second hand shaft 27 of the second sub-display section 21, and the third short pointer 28 is not mounted on the third pointer shaft 28 of the third sub-display section 22.

In this state, the antenna 12 is mounted to the timepiece movement 11. Here, the antenna 12 is mounted with it being already electrically connected to the circuit board 13, and then the buffer member 35 is arranged on the upper surface of the antenna 12. More specifically, the buffer member 35 is arranged on the upper surface of the antenna 12 excluding the area corresponding to the first pointer shaft 26 of the first sub-display section 20. In this state, the circuit board 13 is mounted below the timepiece movement 11, and the antenna 12 is arranged below the bottom plate 31 of the holding member 30.

The solar panel 9 and the dial plate 8 are arranged in this order on the upper surface of the timepiece movement 11. Here, the pointer shaft 17 is inserted into the through hole 16 in the respective center portions of the dial plate 8 and the solar panel 9 such that it protrudes upward from the dial plate 8, and the first pointer shaft 26 of the first sub-display section 20 is inserted into the first through hole 20*a* of the solar panel 9 at the center of the first sub-display section 20 and the circular hole 8*a* of the dial plate 8 such that it protrudes upward from the dial plate 8.

Similarly, the second hand shaft 27 of the second sub-display section 21 is inserted into the second through hole 21*a* of the solar panel 9 at the center of the second sub-display section 21 and the circular hole 8*b* of the dial plate 8 such that it protrudes upward from the dial plate 8, and the third pointer shaft 28 of the third sub-display section 22 is inserted into the third through hole (not shown) of the solar panel 9 at the center of the third sub-display section 22 and the circular hole 8*c* of the dial plate 8 such that it protrudes upward from the dial plate 8.

In this state, the plurality of pointers 18 such as an hour hand, a minute hand, and a second hand are mounted on the pointer shaft 17 in the timepiece movement 11, and the first short pointer 23 which is the first pointer is mounted on the first pointer shaft 26 of the first sub-display section 20. Similarly, the second short pointers 24*a* and 24*b* which are the second pointers are mounted, on the second hand shaft 27 of the second sub-display section 21, and the third short pointer 25 which is the third pointer is mounted on the third pointer shaft 28 of the third sub-display section 22.

Here, except when the first short pointer 23 is mounted on the first pointer shaft 26 of the first sub-display section 12 positioned above the antenna 12, a holding jib (not shown) is arranged below the timepiece movement 11 so as to mount the pointer 18 on the pointer shaft 17, mount the second short pointers 24*a* and 24*b* on the second hand shaft 27 of the second sub-display section 21, and mount the third short pointer 25 on the third pointer shaft 28 of the third sub-display section 22.

On the other hand, when the first short pointer 23 is mounted on the first pointer shaft 26 of the first sub-display section 20 positioned above the antenna 12, the holding jig cannot be used because the antenna 12 is arranged below the first pointer shaft 26. Accordingly, when the first short pointer 23 is mounted on the first pointer shaft 26 of the first sub-display section 20, the first short pointer 23 is mounted on the first pointer shaft 26 without the holding jig.

Here, the lower end 26*a* of the first pointer shaft 26 is inserted into the bearing hole 31*a* provided in the bottom plate 31 of the holding member 30, the upper end 26*b* of the first pointer shaft 26 is inserted into the insertion hole 32*a* in the wheel train bridge 32 in the holding member 30 such that it protrudes upward from the dial plate 8 via the first through hole 20*a* of the solar panel 9 and the circular hole 8*a* of the dial plate 8, and the disc spring 34 is elastically pressed by the wheel train bridge 32 in this state.

Accordingly, the first pointer shaft 26 is rotatably mounted on the holding member 30 with the gear wheel 33 and the disc spring 34 is arranged and interposed between the bottom plate 31 and the wheel train bridge 32 in the holding member 30, and the first short pointer 23 that is the first pointer is mounted on the upper end 26*b* of the first pointer shaft 26 in this state. Here, when the first short pointer 23 is mounted on the first pointer shaft 26, it is mounted to the first pointer shaft 26 without bringing the bottom plate 31 of the holding member 30 into contact with the antenna 12.

That is, setting is such that a mounting force when the first short pointer 23 is mounted on the first pointer shaft 26 is equal to or less than a deforming force with which the bottom plate 31 of the holding member 30 is flexurally deformed. That is, the contact area of the mounting hole 23*c* provided in the mounting piece 23*b* of the first short pointer 23 and the upper end 26*b* of the first pointer shaft 26 to be mounted in the mounting hole 23*c* by press fitting is formed small.

That is, the upper end 26*b* of the first pointer shaft 26 to which the first short pointer 23 is mounted by press fitting is formed having a thin shape whose outer diameter R is 1.0 mm or less. Also, the first short pointer 23 is formed such that the inner diameter of the mounting hole 23*c* in the mounting piece 23*b* is substantially the same as the outer diameter R of the upper end 26*b* of the first pointer shaft 26. That is, it is formed with the fitting tolerance between the upper end 26*b* of the first pointer shaft 26 and the mounting hole 23*c* of the first short pointer 23.

Accordingly, the press fitting force when the first short pointer 23 is mounted on the first pointer shaft 26 by press fitting is formed small. Therefore, the bottom plate 31 can be thinned. In addition, even when the bottom plate 31 is formed to be thin, the bottom plate 31 is hardly flexurally deformed, so that the first short pointer 23 can be reliably and favorably mounted on the first pointer shaft 26.

In this embodiment, even though the press fitting force is small when the upper end 26*b* of the first pointer shaft 26 is pressed into the mounting hole 23*c* in the mounting piece 23*b* provided on one end of the pointer body 23*a* of the first pointer 23, the fitting force with which the upper end 26*b* of the first pointer shaft 26 is fitted into the mounting hole 23*c* of the first short pointer 23 is ensured because the upper end 26*b* of the first pointer shaft 26 is fitted into the mounting hole 23*c* of the first short pointer 23 with the fitting tolerance. Therefore, the first short pointer 23 can be reliably and favorably mounted on the first pointer shaft 26.

Here, the bottom plate 31 of the holding member 30 is arranged with the predetermined space S above the antenna 12. This bottom plate 31 of the holding member 30 is formed such that it is flexurally deformed within the range of the predetermined space S when the first short pointer 23 is mounted on the first pointer shaft 26. Accordingly, even if this bottom plate 31 is flexurally deformed when the first short pointer 23 is mounted on the first pointer shaft 26 by press fitting, this flexural deformation of the bottom plate 31 is within the range of the predetermined space S, so that the bottom plate 31 does not come in contact with the antenna 12.

Also, in the predetermined space S between the bottom plate 31 and the antenna 12, the buffer member 35 is arranged avoiding the area corresponding to the first pointer shaft 26. Accordingly, even though the bottom plate 31 is formed to be thin, the buffer member 35 suppresses the flexural deformation of the bottom plate 31 when the first short pointer 23 is mounted on the first pointer shaft 26. In addition, since the bottom plate 31 does not come in direct contact with the antenna 12, the first short pointer 23 can be mounted on the first pointer shaft 26 without the antenna 12 being impacted and damaged.

Here, since the buffer member 35 is arranged avoiding the area corresponding to the first pointer shaft 26, the press fitting force which is the mounting force when the first short pointer 23 is mounted on the first pointer shaft 26 by press fitting can be dispersed into an area around the first pointer shaft 26 by being prevented from concentrating on the area corresponding to the first pointer shaft 26. By this structure as well, flexural deformation of the bottom plate 31 can be suppressed and the first short pointer 23 can be mounted on the first pointer shaft 26 without the antenna 12 being impacted and damaged.

As a result, the timepiece module 7 is assembled. This timepiece module 7 is incorporated into the wristwatch case 1. Here, before this incorporation, the parting member 10 is arranged in the wristwatch case 1 from above, the timepiece class 2 and the packing 2*a* are mounted on the upper opening portion of the wristwatch case 1, and bush button switches 6 are respectively mounted on side surfaces on the two o'clock side, the four o'clock side, and the eight o'clock side of the wristwatch case 1. In this state, the timepiece module 7 is incorporated into the wristwatch case 1 from below.

Next, the switch operation section 5, which is a crown or the like, is inserted into a side portion of the wristwatch case 1 on the 3 o'clock side so as to be inserted into the timepiece module 7 and mounted thereto. Then, the battery 14 is mounted in the timepiece module 7, and the rear lid 3 is mounted on the lower part of the wristwatch case 1. As a result, the wristwatch is assembled. In the wristwatch assembled as described above, when the wristwatch case 1 receives an impact from outside, the buffer member 35 buffers the impact, whereby the antenna 12 is prevented from being impacted and damaged, and the electrical connection section between the antenna 12 and the circuit board 13 is prevented from being damaged. That is, the antenna 12 is protected.

As described above, this wristwatch includes the antenna 12, the holding member 30 arranged with the predetermined space S above the antenna 12, the first pointer shaft 26 arranged corresponding to an area above the antenna 12 and rotatably held by the holding member 30, and the first short pointer 23 mounted on the first pointer shaft 26, for which setting has been made such that the mounting force when the first short pointer 23 is mounted on the first pointer shaft 26 is equal to or less than the deforming force with which the holding member 30 is flexurally deformed, so that the sensitivity of the antenna 12 is ensured and the first pointer shaft 26 can be freely arranged without affecting the antenna 12.

That is, this wristwatch is structured such that the holding member 30 which holds the first pointer shaft 26 of the first sub-display section 20 is arranged above the antenna 12 in a non-contact state. Therefore, the antenna 12 is not required to be processed. Accordingly, the antenna 12 has favorable processability and assemblability. In addition, its sensitivity can be ensured and its size can be increased.

Also, in this wristwatch, setting has been made such that the mounting force when the first short pointer 23 is mounted on the first pointer shaft 26 is equal to or less than the flexural deformation force of the holding member 30. Therefore, the first pointer 23 can be mounted on the first pointer shaft 26 while hardly flexurally deforming the holding member 30 without bringing the holding member 30 into contact with the antenna 12. Accordingly, the first pointer shaft 26 can be freely arranged without affecting the antenna 12. Therefore, the wristwatch can be improved in design.

In this embodiment, the contact area of the mounting hole 23*c* in the mounting piece 23*b* of the first short pointer 23 and the upper end 26*b* of the first pointer shaft 26 mounted on this mounting hole 23*c* by press fitting is small. Therefore, the press fitting force when the first short pointer 23 is mounted on the first pointer shaft 26 by press fitting can be reduced. Accordingly, the first short pointer 23 can be favorably mounted on the first pointer shaft 26 while hardly flexurally deforming the holding member 30.

That is, the upper end 26*b* of the first pointer shaft 26 to which the first short pointer 23 is attached is formed having a small and thin shape whose outer diameter R is 1.0 mm or less, and the first short pointer 23 is formed such that the inner diameter of the mounting hole 23*c* is substantially the same as the outer diameter R of the upper end 26*b* of the first pointer shaft 26, whereby that the contact area of the mounting hole 23*c* of the first short pointer 23 and the upper end 26*b* of the first pointer shaft 26 can be reduced. As a result, the press fitting force when the first short pointer 23 is mounted on the first pointer shaft 26 by press fitting can be reduced.

In this wristwatch, since the press fitting force when the first short pointer 23 is mounted on the first pointer shaft 26 by press fitting can be reduced, the first short pointer 23 can be reliably and favorably mounted on the first pointer shaft 26 while hardly flexurally deforming the holding member 30. As a result, the holding member 30 does not come in contact with the antenna 12, and the antenna 12 is prevented from being affected.

In this embodiment, the inner diameter of the mounting hole 23*c* of the first pointer 23 is substantially the same as the outer diameter of the upper end 26*b* of the first pointer shaft 26, and the upper end 26*b* of the first pointer shaft 26 and the mounting hole 23*c* of the first short pointer 23 are formed with the fitting tolerance. Therefore, even though the press fitting force when the upper end 26*b* of the first pointer shaft 26 is pressed into the mounting hole 23*c* of the first short pointer 23 is small, the first short pointer 23 can be reliably and favorably mounted on the first pointer shaft 26 with the fitting tolerance between the upper end 26*b* of the first pointer shaft 26 and the mounting hole 23*c* of the first short pointer 23.

That is, even though the press fitting force when the upper end 26*b* of the first pointer shaft 26 is pressed into the mounting hole 23*c* of the first short pointer 23 is small, the fitting force with which the upper end 26*b* of the first pointer shaft 26 is fitted into the mounting hole 23*c* of the first short pointer 23 can be ensured with the fitting tolerance between the upper end 26*b* of the first pointer shaft 26 and the mounting hole 23*c* of the first short pointer 23. Therefore, the first short pointer 23 can be reliably and favorably mounted on the first pointer shaft 26.

Also, in this wristwatch, the holding member 30 is arranged above the antenna 12 via the predetermined space S such that it can be flexurally deformed within the range of the predetermined space S when the first short pointer 23 is mounted on the first pointer shaft 26. Accordingly, the holding member can be flexurally deformed within the range of the predetermined spacing S between the holding member 30 and the antenna 12 when the first short pointer 23 is mounted on the first pointer shaft 26 without using a holding jib (not shown) As a result, the holding member 30 can be prevented from coming in contact with the antenna 12.

In this embodiment, the holding member 30 includes the bottom plate 31 and the wheel train bridge 32 which are incorporated into the timepiece movement 11, the lower end 26*a* of the first pointer shaft 26 is rotatably mounted on the bottom plate 31, and the bottom plate 31 is arranged above the antenna 12. Accordingly, the bottom plate 31 of the holding member 30 can be formed to be thin, whereby the entire holding member 30 can be formed to be thin. As a result, the timepiece module 7 can be thinned, whereby the entire wristwatch can be thinned.

Moreover, in this wristwatch, the buffer member 35 is arranged in the space S between the antenna 12 and the holding member 30. Accordingly, even though the bottom plate 31 of the holding member 30 is formed to be thin, the buffer member 35 can inhibit the bottom plate 31 from being flexurally deformed when the first short pointer 23 is mounted on the first pointer shaft 26. As a result, the antenna 12 can be reliably and favorably protected.

Accordingly, in this wristwatch, the bottom plate 31 of the holding member 30 does not come in direct contact with the antenna 12. As a result, the antenna 12 can be reliably prevented from being impacted and damaged by the bottom plate 31. When the wristwatch case 1 receives an impact from outside, the buffer member 35 buffers the impact so as to prevent the antenna 12 from being impacted and damaged and prevent the electrical connection section between the antenna 12 and the circuit board 13 from being damaged, whereby the antenna 12 can be reliably and favorably protected.

In this embodiment, the buffer member 35 is arranged avoiding the area corresponding to the first pointer shaft 26. Therefore, the press fitting force which is the mounting force when the first short pointer 23 is mounted on the first pointer shaft 26 by press fitting does not concentrate on the area corresponding to the first pointer shaft 26 and is dispersed into the buffer member 35 positioned around the first pointer shaft 26. By this structure as well, flexural deformation of the bottom plate 31 is suppressed and the antenna 12 is prevented from being impacted and damaged. As a result, the first short pointer 23 can be favorably mounted on the first pointer shaft 26.

Furthermore, this wristwatch includes the pointer shaft 17 to which the plurality of pointers 18 such as a second hand, a minute hand, and an hour hand are mounted, the first pointer shaft 26 of the first sub-display section 20 to which the first short pointer 23 is mounted, the second hand shaft 27 of the second sub-display section 21 to which the second short pointers 24*a* and 24*b* are mounted, and the third pointer shaft 28 of the third sub-display section 22 to which the third short pointer 25 is mounted. Among the pointer shaft 17 and the first to third pointer shafts 26 to 28, the first pointer shaft 26 is arranged above the antenna 12. By this structure, all of the pointer shaft 17 and the first to third pointer shafts 26 to 28 can be favorably arranged without affecting the antenna 12.

In the above-described embodiment, the first pointer shaft 26 of the first sub-display section 20 to which the first pointer 23 is mounted is arranged above the antenna 12. However, the present invention is not limited thereto. For example, a structure may be adopted in which the second hand shaft 27 of the second sub-display section 21 to which the second short pointers 24*a* and 24*b* are mounted or the third pointer shaft 28 of the third sub-display section 22 to which the third short pointer 25 is mounted is arranged above the antenna 12.

Also, the present invention is not limited to the above-described modification examples, and a structure may be adopted in which the pointer shaft 17 to which the plurality of pointers 18 such as a second hand, a minute hand, and an hour hand are mounted is arranged above the antenna 12. In this case, the length of the pointer shaft 17 in the axial direction is preferably substantially the same as the length of the first pointer shaft 26 of the first sub-display section 20 in the axial direction.

Moreover, in the above-described embodiment and the modification examples, the contact area of the mounting hole 23*c* of the first short pointer 23 and the upper end 26*b* of the first pointer shaft 26 is small so that the mounting force when the first short pointer 23 is mounted on the first pointer shaft 25 is equal to or less than the deforming force of the holding member 30. However, the present invention is not limited thereto. For example, the rigidity and the strength of the bottom plate 31 of the holding member 30 may be made higher than the mounting force that is exerted when the first short pointer 23 is mounted on the first pointer shaft 26.

Furthermore, in the above-described embodiment and the modification examples, the present invention has been applied in a pointer type wristwatch. However, the present invention is not necessarily required to be applied in a pointer type wristwatch. For example, the present invention is applicable to various types of pointer type timepieces such as a travel watch, a pocket watch, an alarm clock, a table clock, and a wall clock.

While the present invention has been described with reference to the preferred embodiments, it is intended that the invention be not limited by any of the details of the description therein but includes all the embodiments which fall within the scope of the appended claims.

What is claimed is:

1. A timepiece comprising:

an antenna;

a holding member arranged with a predetermined space above the antenna;

a pointer shaft arranged at a position which overlaps the antenna in a plan view and rotatably held by the holding member; and a pointer mounted on the pointer shaft.

2. The timepiece according to claim 1, wherein a mounting force at a time of mounting the pointer on the pointer shaft is set equal to or less than a maximum deforming force with which flexural deformation of the holding member is within a range of the predetermined space.

3. The timepiece according to claim 1, wherein flexural deformation of the holding member is within a range of the predetermined space when the pointer is mounted on the pointer shaft.

4. The timepiece according to claim 2, wherein the flexural deformation of the holding member is within the range of the predetermined space when the pointer is mounted on the pointer shaft.

5. The timepiece according to claim 1, further comprising a buffer member arranged between the antenna and the holding member.

6. The timepiece according to claim 2, further comprising a buffer member arranged between the antenna and the holding member.

7. The timepiece according to claim 3, further comprising a buffer member arranged between the antenna and the holding member.

8. The timepiece according to claim 4, further comprising a buffer member arranged between the antenna and the holding member.

9. The timepiece according to claim 1, further comprising:

a plurality of additional pointer shafts, wherein the pointer shaft arranged at the position which overlaps the antenna in the plan view and rotatably held by the holding member is a pointer shaft of a sub-display section arranged above the antenna, and wherein the pointer to be mounted on the pointer shaft of the sub-display section is a short pointer of the sub-display section.

10. The timepiece according to claim 2, further comprising:

a plurality of additional pointer shafts, wherein the pointer shaft arranged at the position which overlaps the antenna in the plan view and rotatably held by the holding member is a pointer shaft of a sub-display section arranged above the antenna, and wherein the pointer to be mounted on the pointer shaft of the sub-display section is a short pointer of the sub-display section.

11. The timepiece according to claim 3, further comprising:

a plurality of additional pointer shafts, wherein the pointer shaft arranged at the position which overlaps the antenna in the plan view and rotatably held by the holding member is a pointer shaft of a sub-display section arranged above the antenna, and wherein the pointer to be mounted on the pointer shaft of the sub-display section is a short pointer of the sub-display section.

12. The timepiece according to claim 4, further comprising:

a plurality of additional pointer shafts, wherein the pointer shaft arranged at the position which overlaps the antenna in the plan view and rotatably held by the holding member is a pointer shaft of a sub-display section arranged above the antenna, and wherein the pointer to be mounted on the pointer shaft of the sub-display section is a short pointer of the sub-display section.

13. The timepiece according to claim 5, further comprising:

a plurality of additional pointer shafts, wherein the pointer shaft arranged at the position which overlaps the antenna in the plan view and rotatably held by the holding member is a pointer shaft of a sub-display section arranged above the antenna, and wherein the pointer to be mounted on the pointer shaft of the sub-display section is a short pointer of the sub-display section.

14. The timepiece according to claim 6, further comprising:

a plurality of additional pointer shafts, wherein the pointer shaft arranged at the position which overlaps the antenna in the plan view and rotatably held by the holding member is a pointer shaft of a sub-display section arranged above the antenna, and wherein the pointer to be mounted on the pointer shaft of the sub-display section is a short pointer of the sub-display section.

15. The timepiece according to claim 7, further comprising:

a plurality of additional pointer shafts, wherein the pointer shaft arranged at the position which overlaps the antenna in the plan view and rotatably held by the holding member is a pointer shaft of a sub-display section arranged above the antenna, and wherein the pointer to be mounted on the pointer shaft of the sub-display section is a short pointer of the sub-display section.

16. The timepiece according to claim 8, further comprising:

a plurality of additional pointer shafts, wherein the pointer shaft arranged at the position which overlaps the antenna in the plan view and rotatably held by the holding member is a pointer shaft of a sub-display section arranged above the antenna, and wherein the pointer to be mounted on the pointer shaft of the sub-display section is a short pointer of the sub-display section.

* * * * *